US005711274A

United States Patent [19]

Drummer

[11] Patent Number: 5,711,274

[45] Date of Patent: Jan. 27, 1998

[54] SYSTEM AND METHOD FOR REDUCING THE FUEL PRESSURE IN A FUEL INJECTION SYSTEM

[75] Inventor: Eugen Drummer, Steyr, Austria

[73] Assignee: Robert Bosch GmbH, Stuttgart, Germany

[21] Appl. No.: 696,870

[22] PCT Filed: Jun. 1, 1995

[86] PCT No.: PCT/DE95/00713

§ 371 Date: Oct. 25, 1996

§ 102(e) Date: Oct. 25, 1996

[87] PCT Pub. No.: WO96/19659

PCT Pub. Date: Jun. 27, 1996

[30] Foreign Application Priority Data

Dec. 20, 1994 [DE] Germany ..... 44 45 586.0

[51] Int. Cl.[6] ..... F02M 41/00

[52] U.S. Cl. ..... 123/456; 123/467

[58] Field of Search ..... 123/450, 467, 123/510, 511; 239/88, 96

[56] References Cited

U.S. PATENT DOCUMENTS 4,782,808 11/1988 Bostick et al. ..... 123/467

5,074,272 12/1991 Bostick et al. ..... 123/467

5,159,911 11/1992 Williams et al. ..... 123/467

5,408,970 4/1995 Burkhard et al. ..... 123/467

5,441,029 8/1995 Hlousek ..... 123/467

*Primary Examiner*—Thomas N. Moulis

*Attorney, Agent, or Firm*—Edwin E. Greigg; Ronald E. Greigg

[57] ABSTRACT

A system and method for reducing the fuel pressure in a fuel injection system after the internal combustion engine to be supplied has been shut off, in which a high fuel pressure built up in a high-pressure reservoir chamber (common rail) by a high-pressure feed pump, is relieved into the supply tank via control valves that control the injection event and are provided on the injection valves that communicate with the common rail. For purposes of this pressure relief, the control valves are triggered such that they connect a pressure chamber of the injection valve with the common rail or the supply tank so briefly that the pressure urging the valve member of the injection valves in the opening direction remains below an opening pressure of the injection valves, and this triggering process of the control valves is repeated until a desired pressure in the common rail is reached.

15 Claims, 2 Drawing Sheets

Fig. 1
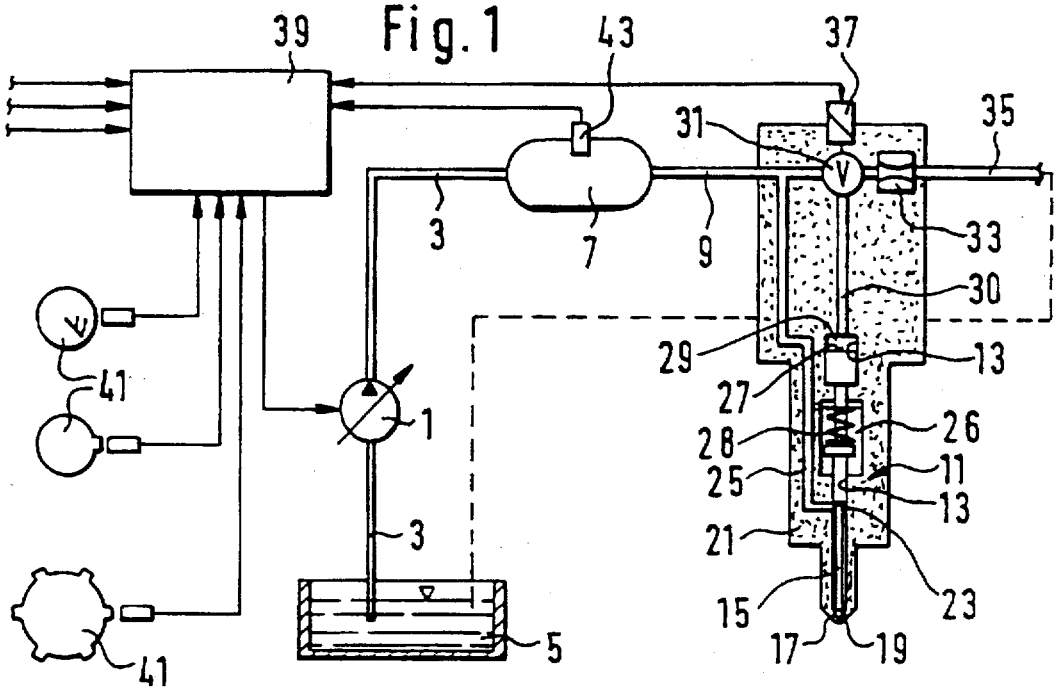
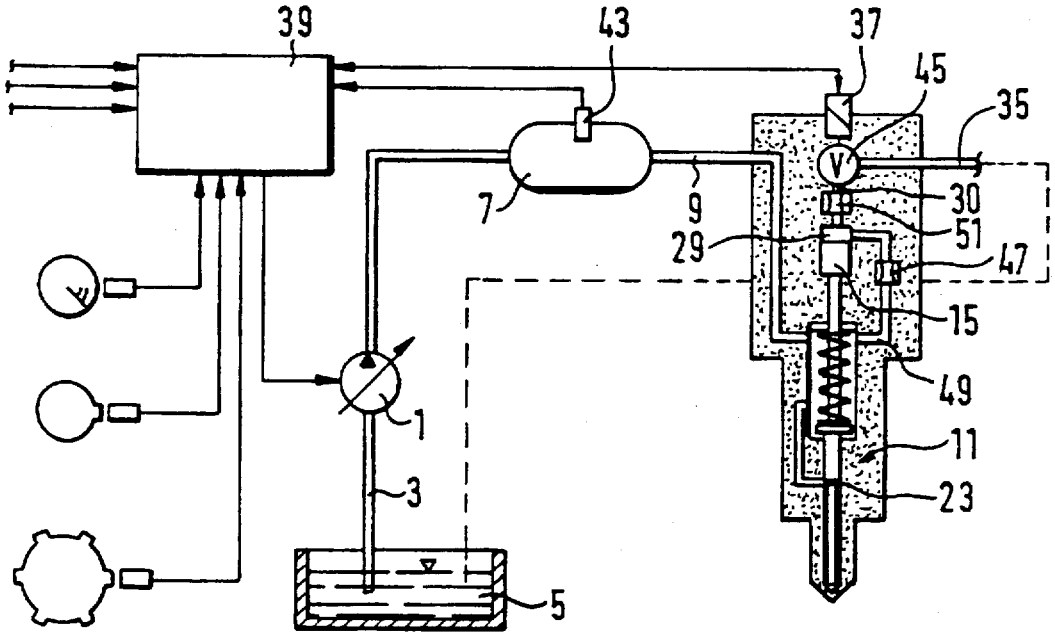
Fig. 2

SYSTEM AND METHOD FOR REDUCING THE FUEL PRESSURE IN A FUEL INJECTION SYSTEM

PRIOR ART

The invention is based on a fuel injection system for internal combustion engines. In one such fuel injection system, known from the professional journal ATZ/MTZ, special issue "Motor und Umwelt" [Engine and Environment] 1992, pp. 28–30, a high-pressure feed pump fills a high-pressure reservoir with fuel from a supply tank. From the high-pressure reservoir (common rail), pressure lines lead to the various injection valves that protrude into the combustion chamber of the engine to be supplied; in the known system, these valves discharge via a first conduit directly into a first pressure chamber that urges the valve member of the injection valve in the opening direction, and via a second conduit they can be made to communicate with a second pressure chamber, forming a control chamber, that urges the valve member in the closing direction. A 3/2-way control valve is inserted into this second conduit and connects the control chamber at the valve member with the pressure line that begins at the high-pressure reservoir, or with a relief line to the supply tank.

The 3/2-way control valve is actuated by a magnet valve, which is triggered by an electronic control unit that processes various operating parameters of the engine.

The injection valve is kept closed by the communication of the control chamber with the high-pressure reservoir; for that purpose, the pressure engagement face of the valve member that protrudes into the control chamber is embodied as larger than the pressure engagement face protruding into the first pressure chamber, in the opening direction.

If an injection is to take place at the injection valve, then the control valve connects the control chamber to the relief line, so that the high pressure in the control chamber is relieved via this line into the supply tank; to control the course of injection, a throttle is also provided in the relief line. The pressure reduction in the control chamber, as a consequence of the pressure in the first pressure chamber that communicates constantly with the common rail, effects an opening stroke motion of the valve member, so that an injection cross section is opened at the injection valve, by way of which the fuel is injected at high pressure into the combustion chamber of the engine. The injection is terminated by switching the control valve over again and connecting the control chamber to the common rail, in the course of which the high fuel pressure builds up again in the control chamber, so that the valve member is displaced back into its closing position.

The known fuel injection system has the disadvantage, however, that the high fuel pressure remains in the system for a long time even after the engine has been turned off; this makes maintenance and repair work quite dangerous, so that the known system does not meet the usual demands for safety.

ADVANTAGES OF THE INVENTION

The method according to the invention for reducing the fuel pressure in a fuel injection system has the advantage over the prior art that it is possible to drop the high pressure in the common rail and the system communicating with it to a slight, harmless pressure level after the engine has been shut off. This is done by means of components already present in the system, so that in contrast to other versions, no additional pressure valve and no further line is needed, which in particular reduces the effort involved in production and hence the cost for the injection system.

The pressure relief is advantageously effected via the control valve and the pressure chambers of the injection valve into the supply tank; for this purpose, only a single further triggering capability of the magnet valve that actuates the control valve on the electronic control unit after the engine is shut off needs to be provided. The triggering of the control valve is then done so briefly that the pressure required to lift the valve member cannot build up at the injection valve. Depending on the structural design, this is accomplished either by briefly relieving the pressure of the control chamber at the valve member or by briefly imposing pressure on the pressure chamber acting upon the valve member in the opening direction, followed by refilling of the control chamber or pressure relief of the pressure chamber, so that the high pressure can be reduced continuously via the relief line into the supply tank.

To attain the briefest possible triggering of the control valve, the electronic control unit triggers the magnet valve at a high frequency, which is preferably attained by means of a two-part triggering (preinjection and main injection) and by the adoption of a high engine speed; all the injection valves of the engine are included in this relief process. The triggering of the individual control valves takes place in succession, preferably in the same order as the order of ignition of the individual cylinders.

In order to assure that the triggering duration is chosen to be so short only that fuel can escape from the line system but no injection will occur, the pressure in the high-pressure system is monitored during the pressure relief operation by means of at least one pressure sensor, which is coupled to the electronic control unit that adapts the triggering duration of the magnet valves that actuate the control valves to the existing system pressure. By means of this adaptation, it is advantageously possible to shorten the evacuation time, since at lower pressures in the system the triggering time of the magnet valves can already be lengthened.

Further advantages and advantageous features of the subject of the invention can be learned from the specification, drawing and claims.

BRIEF DESCRIPTION OF THE DRAWINGS

Three exemplary embodiments of the fuel injection system according to the invention for carrying out the method for reducing the fuel pressure after the engine to be supplied has been shut off are shown in the drawing and will be described in the ensuing description.

FIG. 1 shows a first exemplary embodiment in a schematic view, partially in section, in which the injection valve has two pressure chambers acting in opposite directions on the valve member of the injection valve, of which a first pressure chamber communicates continuously with the high-pressure system and a second pressure chamber, which controls the reciprocating motion of the valve member, can be made to communicate by means of a 3/2-way control valve with the high-pressure system or a supply tank;

FIG. 2 shows a second exemplary embodiment analogous to FIG. 1, in which the second pressure chamber can be made to communicate with the supply tank by means of a 2/2-way control valve;

DETAILED DESCRIPTION OF THE EXEMPLARY EMBODIMENTS

Figure 3:
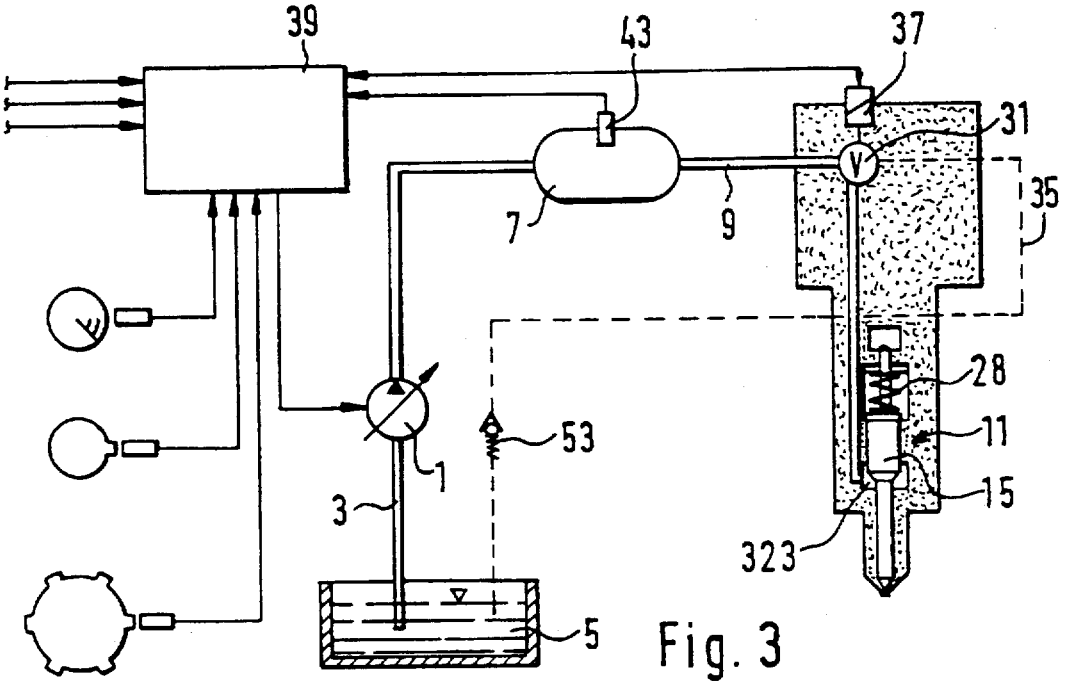
FIG. 3 shows a third exemplary embodiment in a schematic view, in which only one pressure chamber is provided, which urges the valve member in the opening direction counter to the spring force and can be made to communicate with the high-pressure system or supply tank by means of a 3/2-way control valve.

In the first exemplary embodiment of the fuel injection system, shown in FIG. 1, a pressure-controllable high-pressure feed pump 1 pumps fuel at high pressure via a feed line 3 from a supply tank 5 to a high-pressure reservoir chamber 7 (common rail), from which a plurality of pressure lines 9, corresponding in number to the number of injection points, lead to the various injection valves 11 that protrude into the combustion chamber of the engine to be supplied.

The injection valve 11 has a pistonlike valve member 15, which is axially displaceable in a guide bore 13 and has a conical valve sealing face 17 on one end, by which it cooperates with a valve seat face on the housing 21 of the injection valve 11; in a known manner, injection openings not shown in further detail adjoin the valve seat 19 downstream. The valve member 15 protrudes into two pressure chambers formed inside the guide bore 13; of these, a first pressure chamber 23, acting upon the valve member in the opening direction, is formed by a reduction in the cross section of the valve member 15. This first pressure chamber 23 communicates constantly with the common rail 7 via a pressure conduit 25, which discharges into the pressure line 9, and in a known manner continues on as far as the valve seat 19, via an annular gap between the valve member 15 and the guide bore 13.

In the middle region, the valve member 15 passes through a spring chamber 26, which is sealed off from the high fuel pressure and in which a valve spring 28 is disposed that urges the valve member 15 in the closing direction.

On its end remote from the valve seat 19, the valve member has a cross-sectional enlargement, whose end face 27 remote from the valve seat defines a second pressure chamber that forms a control chamber 29 and urges the valve member 15 in the closing direction; this pressure chamber is connected via a connecting conduit 30 to a 3/2-way control valve 31, which connects the control chamber 29 either with a relief line 35, containing a throttle 33, into the supply tank 5 acting as a relief chamber, or with the pressure line 9 of the common rail 7; a relief line without a throttle is analogously also possible. The 3/2-way control valve is actuated by an electromagnet 37, which is triggered by an electronic control unit 39 that in turn processes various operating parameters (rpm, accelerator pedal position, etc.) of the engine to be supplied, which are supplied to it via sensors 41. In order to be able to detect and process the pressure inside the high-pressure system as well, a pressure sensor 43 is also inserted into the common rail 9.

The fuel injection system functions in a known manner during engine operation; the high-pressure feed pump 1 first fills the common rail 7 with fuel that is at high pressure. This high fuel pressure is propagated via the pressure lines 9 to the various injection valves 11, where the high pressure fuel acts upon the first pressure chamber 23. In this process, the valve member 15 is kept in the closed state of the injection valve 11 in contact with the valve seat 19 by the force of the valve spring 28 and the pressure of the control chamber 29, which through the 3/2-way control valve 31 communicates with the pressure line 9; the end face 27 of the valve member 15 protruding into the control chamber 29 is larger than the annular shoulder that defines the first pressure chamber 23.

If an injection is to take place at the injection valve 11, the control chamber 29 is made to communicate through the 3/2-way control valve 31 with the relief line 35, so that the pressure in the control chamber 29 is relieved into the supply tank 5. As a consequence, the pressure in the pressure chamber 23, acting in the opening direction on the valve member 15, exceeds the forces acting on the valve member 15 in the closing direction, so that the valve member 15 lifts from the valve seat 19, and fuel is injected via the injection openings. The process of relieving the control chamber 29 and thus the opening stroke motion of the valve member 15 can be varied by way of the dimensioning of the throttle 33.

The end of the injection event is initiated by switching the 3/2-way control valve 31 over again; this valve then once again connects the control chamber 29 to the pressure line 9, so that in the control chamber 29 a high pressure builds up again and moves the valve member 15 back onto its valve seat 19.

Figure 4:
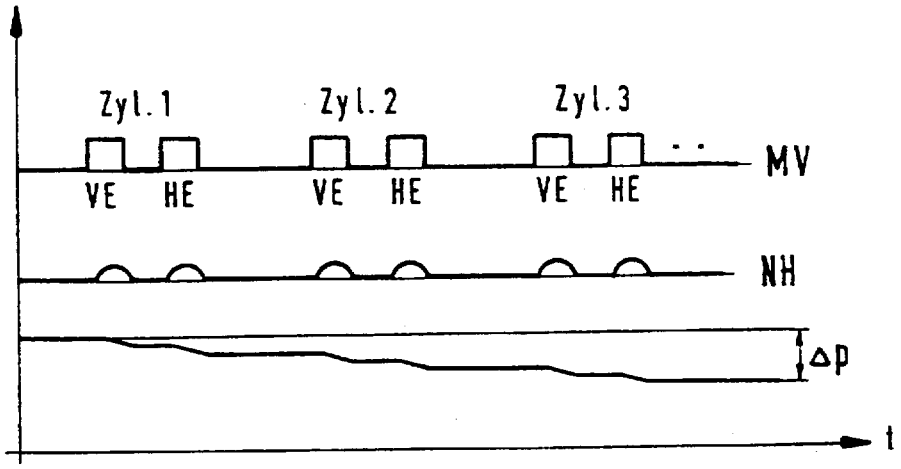
FIG. 4 is a graph in which the duration of the trigger signal of the magnet valve, the duration of the magnet valve needle stroke, and the pressure in the system are plotted over time.

The pressure reduction according to the invention in the common rail 7 and in the pressure lines 9 after the engine has been shut off will be explained in conjunction with the graph shown in FIG. 4, in which the duration of the trigger signal of the electromagnet 37 (MV), the needle stroke (NH) of the 3/2-way control valve 31 that is actuated by the electromagnet 37, and the pressure course ($\Delta P$) in the common rail 7 are plotted over time (t).

The control unit 39 triggers the electromagnet 37, after the shutoff of the engine to be supplied, at high frequency, which can be accomplished for instance by means of a divided triggering (analogous to a preinjection and main injection).

Because current is supplied only briefly to the electromagnet 37, the valve member, actuated by this electromagnet, of the 3/2-way control valve 31 executes only a ballistic needle stroke (NH), so that the 3/2-way control valve 31 does not completely open the connection between the control chamber 29 and the relief line 35. In this way it is assured that the pressure in the control chamber 29 will not drop so far that the differential pressure from the pressure chamber 23 is sufficient to allow the valve member 15 of the injection valve 11 to lift from its seat 19. After this brief opening of the communication between the control chamber 29 and relief line 35, as a result of which some of the high fuel pressure from the control chamber 29 is relieved into the supply tank 5, the control chamber 29 is then re-connected with the pressure line 9 and filled with the high system pressure.

This brief opening of the communication between the control chamber 29 and the relief line 35 is effected until the high fuel pressure in the common rail 7 has dropped to a certain value ($\Delta P$). The injection valves 11 are triggered in succession, which by way of example can be done in the order of the ignition of the various cylinders of the engine.

The process of pressure reduction is monitored by means of the pressure sensor 43 of the control unit 39, which as a function of the pressure prevailing in the common rail 7 adapts the triggering duration of the 3/2-way control valves 31. The electromagnet 37 is triggered more briefly at high pressure than at low pressure, so that an optimal evacuation time along with a simultaneous reliable avoidance of fuel injection can be attained.

The second exemplary embodiment of a fuel injection system, shown in FIG. 2, for performing the method of the invention differs from the first exemplary embodiment shown in FIG. 1 only in the way the control chamber 29 at the injection valve 11 communicates with the pressure line 9 and the relief line 35, and in the design of the control valve, which is now embodied as a 2/2-way control valve 45 and opens and closes the communication of the control chamber 29 with the relief valve 35. The control chamber 29 communicates with the pressure line 9 via a connecting line 49 that contains a first throttle restriction 47. A second throttle restriction 51 is inserted into the connecting conduit 30 leading to the 2/2-way control valve 45, and by way of the design of this throttle restriction the outflow of fuel from the control chamber 29 into the fuel tank 5 and thus the opening stroke motion of the valve member 15 can be adjusted.

The second exemplary embodiment functions similarly to the first; during engine operation, the lifting of the valve member 15 from the valve seat 19 and thus the injection event are effected as a consequence of the opening of the communication between the control chamber 29 and relief line 35, by means of the 2/2-way control valve 45 controlled by the electromagnet 37.

The pressure relief of the common rail 7 after shutoff of the engine is effected, as described for the first exemplary embodiment, by the brief opening of the communication between the control chamber 29 and the relief line 35, so that as the control chamber 29 is constantly refilled from the common rail 7, the pressure of the common rail can be lowered. Once again, the pressure relief of the control chamber 29 is effected only so briefly and to such a slight extent that no injection occurs at the injection valves 11.

The third exemplary embodiment shown in FIG. 3 has only one pressure chamber 323, acting on the valve member 15 at the injection valve 11; by way of its communication with the pressure line 9 from the common rail 7, controlled by means of the 3/2-way control valve 31, the opening stroke of the valve member 15 and thus the opening of the injection valve 11 are effected in a known manner counter to the force of the valve spring 28, while conversely the pressure relief and consequently the closure of the injection valve 11 are effected via the communication of the pressure chamber 323 with the relief line 35. A pressure valve inserted into the relief line 35 assures a certain standing pressure in the pressure chamber 323. The reduction of the high fuel pressure in the common rail 7 after shutoff of the engine is effected in the third exemplary embodiment by means of a brief communication of the pressure chamber 323 with the pressure line 9, which, however, once again is effected so briefly that on the one hand the pressure necessary for injection cannot build up in the pressure chamber 323, and on the other the pressure is above the opening pressure of the pressure valve 53 in the relief line 35, so that the high pressure in the common rail 7, as already described, can be reduced down to the opening pressure of the pressure valve 53 by repeated triggering of the 3/2-way control valve 31.

It is thus possible with the method of the invention to enable a pressure reduction, necessary for safety reasons, in the injection system after shutoff of the engine to be supplied, without having to provide additional, expensive pressure valves.

The foregoing relates to preferred exemplary embodiments of the invention, it being understood that other variants and embodiments thereof are possible within the spirit and scope of the invention, the latter being defined by the appended claims.

What is claimed:

1. A method for reducing the fuel pressure in a fuel injection system for internal combustion engines, in which the fuel injection system includes a pump (1) for feeding fuel into a common rail (7), pressure lines (9) that lead to first and second pressure chambers in injection valves (11), a valve member in said injection valve, a control valve (31) on the injection valve (11), said method comprising controlling said control valve to control an injection through the injection valve (11) which for the control connects said second pressure chamber (29, 323) of the injection valve (11) that acts upon a valve member (15) of the injection valve (11) with the common rail (7) or a relief line (35) into a supply tank (5), controlling the pressure in the common rail (7), after shutoff of the engine to terminate fuel feeding by the pump (1), controlling the control valve to relieve the supply tank (5) via the control valve (31), connecting the control valve (31) to the pressure chamber (29, 323) of the injection valve (11) briefly with the common rail (7) or the supply tank (5) so that the pressure acting upon the valve member (15) of the injection valve (11) in the opening direction remains below an opening pressure of the injection valve (11), and this triggering operation of the control valve (31, 323) is repeated until a desired reduced pressure in the common rail (7) is attained.

2. The method in accordance with claim 1, which comprises triggering the control valves (31, 45) for reducing the pressure in the common rail (7) at high frequencies after the engine has been shut off.

3. The method in accordance with claim 1, which comprise triggering the control valves (31, 45) provided on the individual injection valve (11) for reducing the pressure in the common rail (7) at high frequencies in succession after the engine has been shut off.

4. A fuel injection system for reducing a fuel pressure in a fuel injection system for internal combustion engines, comprising a pump (1) for feeding fuel into a common rail (7), a fuel injection valve (11), an injection valve member (15) operative in said fuel injection valve, first and second pressure chambers in said injection valve that act upon the injection valve member (15), said first pressure chamber (23) communicates constantly with the common rail (7) and fuel under pressure urges the valve member in an opening direction, a second pressure chamber forms a control chamber (29) and fuel under pressure urges the valve member (15) in the closing direction, pressure lines (9) lead from said common rail (7) to each of said pressure chambers, a control valve (31) on said injection valve, said control valve controls flow of fuel from said second pressure chamber to a relief line (35) which feeds fuel in said relief line to a supply tank, in that the pressure in the common rail (7) after shutoff of the engine and termination of feeding of the pump (1) is relieved into the supply tank (5) via the control valve (31), the control valve (31) connects the pressure chamber (29, 323) of the injection valve (11) briefly with the common rail (7) or the supply tank (5) so that the pressure acting upon the valve member (15) of the injection valve (11) in the opening direction remains below an opening pressure of the injection valve (11), and this triggering operation of the control valve (31, 323) is repeated until a desired reduced pressure in the common rail (7) is attained.

5. A fuel injection system as set forth in claim 4, in which said second pressure chamber communicates constantly with the common rail (7) via a connecting line (49), said connecting line includes a first throttle (47), and said second chamber is made to communicate with the relief chamber (5) by means of the control valve embodied as a 2/2-way valve (45).

6. A fuel injection system as set forth in claim 4, in which one pressure chamber (323) that urges the valve member (15) in the opening direction is provided on the injection valve (11), and said second pressure chamber is made to communicate with the common rail (7) or a relief chamber (5) by means of the control valve embodied as a 3/2-way valve (31).

7. A fuel injection system in accordance with claim 6, in which a pressure valve (53) that opens in a direction of the relief chamber (5) is disposed in the relief line (35) leading from the control valve (31) to the relief chamber (5).

8. A fuel injection system in accordance with claim 4, in which the control valve (31, 45) is connected to an electromagnet (37) that actuates said control valve and is triggered by a control unit (39) that processes operating parameters of the engine.

9. A fuel injection system in accordance with claim 5, in which the control valve (31, 45) is connected to an electromagnet (37) that actuates said control valve and is triggered by a control unit (39) that processes operating parameters of the engine.

10. A fuel injection system in accordance with claim 6, in which the control valve (31, 45) is connected to an electromagnet (37) that actuates said control valve and is triggered by a control unit (39) that processes operating parameters of the engine.

11. A fuel injection system in accordance with claim 8, in which a pressure sensor (43) is connected to the control unit (39) by insertion into the common rail (7) which is connected to the pressure pump (1).

12. A fuel injection system in accordance with claim 9, in which a pressure sensor (43) is connected to the control unit (39) by insertion into the common rail (7) which is connected to the pressure pump (1).

13. A fuel injection system in accordance with claim 10, in which a pressure sensor (43) is connected to the control unit (39) by insertion into the common rail (7) which is connected to the pressure pump (1).

14. A fuel injection system as set forth in claim 4, in which the control valve (31, 45) for reducing the pressure in the common rail (7) are triggered at high frequencies after the engine has been shut off.

15. A fuel injection system as set forth in claim 4, in which the control valve (31, 45) that are provided on individual injection valves (11) for reducing the pressure in the common rail (7) are triggered in succession after the engine has been shut off.

* * * * *